US009637693B2

(12) United States Patent
Kasliwal et al.

(10) Patent No.: US 9,637,693 B2
(45) Date of Patent: May 2, 2017

(54) PROCESS FOR REDUCTION OF SULFUR IN FCC LIQUID PRODUCTS THROUGH THE USE OF CARBON MONOXIDE AS A REDUCING AGENT

(71) Applicant: INDIAN OIL CORPORATION LTD., Kolkata, West Bengal (IN)

(72) Inventors: Pankaj Kumar Kasliwal, Faridabad (IN); Brijesh Kumar Verma, Faridabad (IN); Ganga Shanker Mishra, Faridabad (IN); Arumugam Velayutham Karthikeyani, Faridabad (IN); Latoor Lal Saroya, Faridabad (IN); Mohan Prabhu Kuvettu, Faridabad (IN); Brijesh Kumar, Faridabad (IN); Santanam Rajagopal, Faridabad (IN); Ravinder Kumar Malhotra, Faridabad (IN)

(73) Assignee: INDIAN OIL CORPORATION LTD., Kolkata (IN)

( * ) Notice: Subject to any disclaimer, the term of this patent is extended or adjusted under 35 U.S.C. 154(b) by 271 days.

(21) Appl. No.: 14/352,286

(22) PCT Filed: Oct. 29, 2012

(86) PCT No.: PCT/IB2012/055960
§ 371 (c)(1),
(2) Date: Apr. 16, 2014

(87) PCT Pub. No.: WO2013/064955
PCT Pub. Date: May 10, 2013

(65) Prior Publication Data

US 2014/0299509 A1 Oct. 9, 2014

(30) Foreign Application Priority Data

Nov. 3, 2011 (IN) ..... 1412/KOL/2011

(51) Int. Cl.
*C10G 11/20* (2006.01)
*C10G 11/22* (2006.01)
(Continued)

(52) U.S. Cl.
CPC ..... *C10G 55/06* (2013.01); *C10G 11/20* (2013.01); *C10G 11/22* (2013.01); *C10G 2300/202* (2013.01); *C10G 2300/807* (2013.01)

(58) Field of Classification Search
CPC ..... C10G 11/00; C10G 11/18; C10G 11/182; C10G 11/20; C10G 11/22; C10G 55/06; C10G 2300/202; C10G 2300/807
See application file for complete search history.

(56) References Cited

U.S. PATENT DOCUMENTS 4,350,614 A * 9/1982 Schwartz ..... B01J 29/061 208/120.05
4,479,870 A * 10/1984 Hammershaimb .... C10G 11/18 208/108
(Continued)

FOREIGN PATENT DOCUMENTS

WO 2011/080754 A2 7/2011

*Primary Examiner* — Brian McCaig
(74) *Attorney, Agent, or Firm* — Maschoff Brennan

(57) ABSTRACT

Disclosed herein is an improved fluidized catalytic cracking process for converting normally liquid hydrocarbon feedstock with simultaneous reduction of sulfur content in the liquid products obtained therefrom which comprises carrying out the cracking process in the presence of carbon monoxide gas as a reducing agent. The process optionally includes a step of premixing the hydrocarbon feedstock with carbon monoxide gas causing major sulfur reduction before effecting the cracking. The premixing is done in a specified nozzle assembly linked to the FCC unit.

13 Claims, 1 Drawing Sheet

(51) Int. Cl.
*C10G 55/06* (2006.01)
*C10G 11/18* (2006.01)

(56) References Cited

U.S. PATENT DOCUMENTS

| | | | |
|---|---|---|---|
| 4,790,882 | A | 12/1988 | Barres |
| 4,957,718 | A | 9/1990 | Yoo et al. |
| 4,957,892 | A | 9/1990 | Yoo et al. |
| 4,963,520 | A | 10/1990 | Yoo et al. |
| 5,376,608 | A | 12/1994 | Wormsbecher et al. |
| 5,525,210 | A | 6/1996 | Wormsbecher et al. |

* cited by examiner

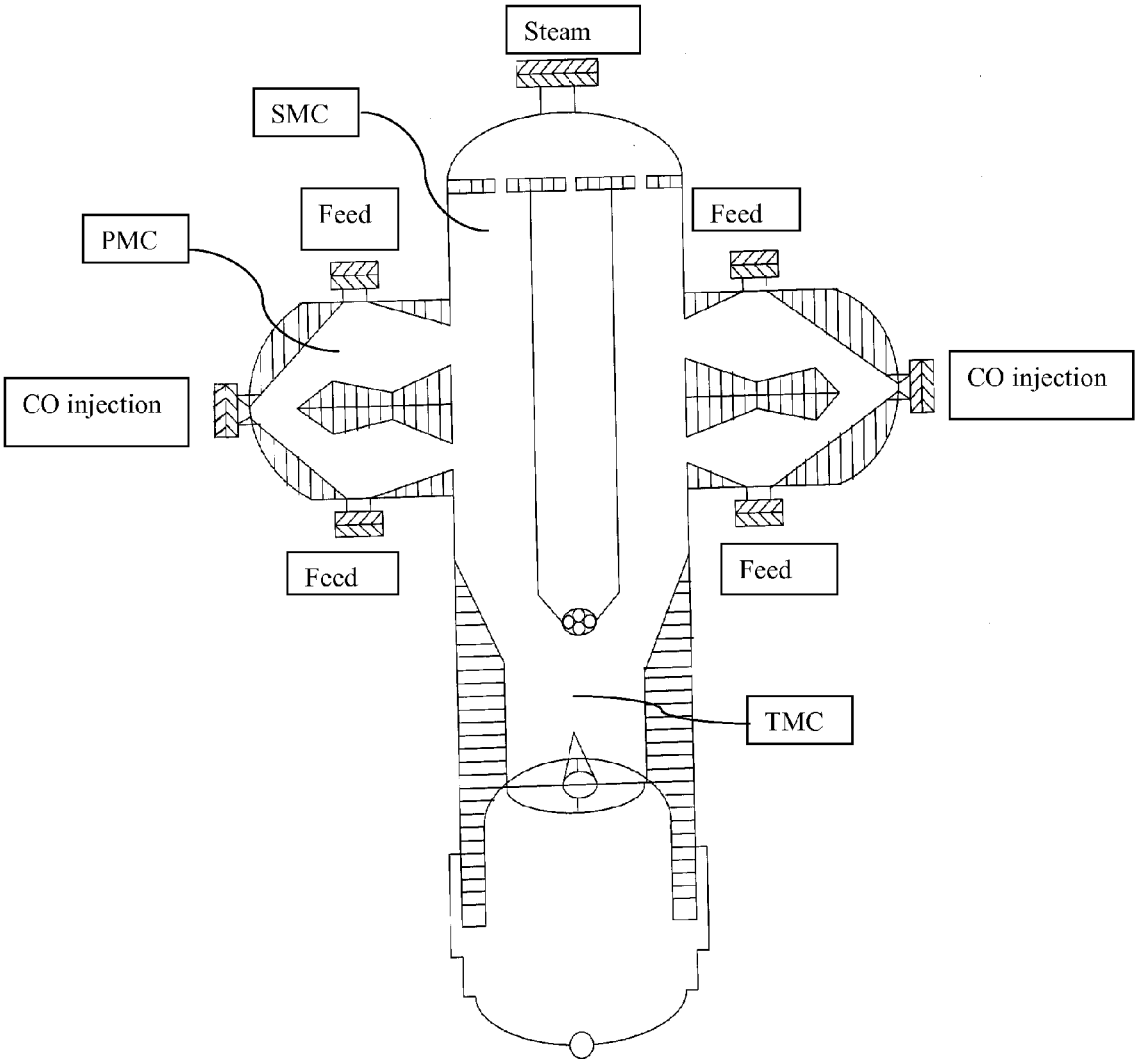
Steam
SMC
Feed
Feed
PMC
CO injection
CO injection
Feed
Feed
TMC

PROCESS FOR REDUCTION OF SULFUR IN FCC LIQUID PRODUCTS THROUGH THE USE OF CARBON MONOXIDE AS A REDUCING AGENT

FIELD OF THE INVENTION

The present invention relates to an improved FCC process capable of providing liquid product streams such as gasoline, diesel etc which is substantially free of sulfur compounds.

BACKGROUND OF THE INVENTION AND PRIOR ART

Catalytic cracking is a petroleum refining process, which is applied commercially on a very large scale. A majority of blending pool (gasoline/TCO) is produced using FCC process. In the process, heavy hydrocarbon feed stock is converted into lighter products by reactions taking place at elevated temperature in the presence of catalyst, with majority of conversion takes place in vapor phase. The feed stock is converted into gasoline, distillate & other liquid cracking products as well as lighter gaseous cracking products of four or less carbon atoms per molecule. The gas partly consists of olefins and partly of saturated hydrocarbons.

During cracking reactions some heavy material known as coke, is deposited onto the catalyst. This reduces its catalytic activity and regeneration is desired. After removal of occluded hydrocarbons from spent cracking catalyst, regeneration is done by burning off the coke to restore the catalytic activity. The three characteristics steps of a typical catalytic cracking process can be identified as follows:

A cracking step in which the hydrocarbons are converted into lighter products,

A stripping step to remove hydrocarbons adsorbed on the catalyst and

A regeneration step to burn off coke from the catalyst.

The regenerated catalyst is then used in the cracking step.

Catalytic cracking feedstocks normally contain sulfur in the form of organic sulfur compounds such as mercaptan, sulfides and thiophenes. The products of the cracking process correspondingly tend to contain sulfur impurities even though about half of the sulfur is converted to Hydrogen Sulfide during cracking process, mainly by catalytic decomposition of non-thiophinic sulfur compounds. Although the amount and type of sulfur in the cracking products are influenced by the feed, catalyst types, additives, conversion and other operating conditions, a significant portion of sulfur generally remains in the product pool. With increasing environmental regulations being applied to petroleum products, the allowable sulfur content of the products has generally been decreased in response to concerns about the emissions of sulfur oxides and other sulfur compounds into the air following combustion processes.

One approach has been to remove the sulfur from the FCC feed by hydrotreating, before cracking is initiated while highly effective, this approach tends to be expensive in terms of the capital cost of the equipment and also since hydrogen consumption is high. Another approach has been to remove the sulfur from the cracked products by hydrotreating. Again while effective, this solution has the drawback that valuable product octane may be lost when the high octane olefins are saturated.

From an economic point of view, it could be desirable to achieve sulfur removal in the cracking process itself since this would effectively de-sulphurize the major components of gasoline, diesel without additional treatment. Various catalytic materials have been developed for the removal of sulfur during FCC process cycle but so far most developments have been centered on removal of sulfur from the regenerator stack gases. The sulfur is removed from stack gases from regenerator but product sulfur levels are not greatly affected. An alternative technology for removal of sulfur oxides from regenerator, removal is based on the use of magnesium aluminium spirids as additives to the circulating catalyst inventory in FCCU.

Exemplary patents on this type of sulfur removal additives include U.S. Pat. Nos. 4,963,520; 4,957,892; 4,957,718; 4,790,882 etc. Again product sulfur levels are not greatly reduced.

A catalyst additive for reduction of sulfur levels in the liquid cracking products is proposed by Wormsbecher and Kim in U.S. Pat. Nos. 5,376,608 and 5,525,210 using a cracking catalyst additive of an alumina supported Lewis acid for the production of reduced-sulfur gasoline, but this system could not achieve commercial success.

OBJECTS OF THE INVENTION

The primary object of the present invention is to realize maximum advantage in a fluidized catalytic cracking (FCC) process particularly with regard to sulfur reduction in gasoline and diesel component.

Another object of the invention is to provide an improved FCC process in which the sulfur levels in the liquid products are simultaneously reduced and there is no separate sulfur reduction step for the purpose.

Still another object of the present invention is to provide an improved FCC process in which sulfur levels are reduced substantially or at least to an acceptable limit with respect to environmental requirements.

Still another object of the present invention is to provide an improved FCC process with reduced sulfur levels in its products which is commercially viable.

DESCRIPTION OF THE INVENTION

An improved catalytic cracking process has now been developed which is capable of improving the reduction of the sulfur content in the liquid products of the cracking process.

Being a well-known reducing agent carbon monoxide (CO) is used for removing sulfur in this invention. The reducing nature of CO and its oxidation to COS leads to a reduction of sulfur in the liquid products.

According to this invention there is provided an improved fluidized catalytic cracking (FCC) process for converting sulfur containing normally liquid hydrocarbon feedstock with simultaneous reduction of sulfur content in the liquid products obtained therefrom comprising carrying out the cracking process in the presence of carbon monoxide gas as a reducing agent The invented process can be worked in any known FCC unit where carbon monoxide (CO) is added to the fluidized cracking catalyst in the riser reactor of the FCC unit where preheated hydrocarbon feed is broken down into lighter hydrocarbon products while reduction of sulfur content in the products takes place simultaneously.

In a preferred embodiment of the invention before bringing the cracking catalyst into contact with the hydrocarbon feedstock for cracking, an intimate atomised mixture of the hydrocarbon feedstock with carbon monoxide reducing agent is separately made and the mixture is then transported to the riser reactor for the desired conversion. Advantage of prior mixing with atomization of the hydrocarbon feed with carbon monoxide is to accomplish major reduction of sulfur from the feed before the cracking process in the riser reactor where conversion of the hydrocarbon feed into lighter liquid hydrocarbon products takes place with further removal of sulfur therefrom.

For commercial application, prior mixture and atomization of the hydrocarbon feed with carbon monoxide is accomplished with the help of a feed nozzle assembly having essentially a primary mixing chamber in flow connected with a secondary mixing chamber as shown in the FIGURE of the accompanying drawing. The schematic design of the said feed nozzle assembly is a subject matter of applicant's pending Indian patent application no 2721/DEL/2009 (PCT application no. WO2011080754).

The feed nozzle assembly of the FIGURE includes at least one primary mixing chamber (PMC) to receive a liquid hydrocarbon feed and a diluent for producing a primary mixture. A secondary mixing chamber (SMC) is flow connected to the primary mixing chamber to receive the primary mixture. In addition, the secondary mixing chamber extends to a tertiary mixture chamber (TMC). Further, a steam inlet is provided to inject streams of steam to the secondary mixing chamber and to the tertiary mixing chamber through a first opening and a second opening, respectively, located within the steam inlet.

The liquid hydrocarbon feedstock is mixed with carbon monoxide (CO) into the primary mixing chamber PMC of the nozzle assembly where intimate mixing of the feedstock takes place with CO. The mixture is then made to be swept into the secondary mixing chamber SMC of the said nozzle assembly where preferably steam being introduced as a diluent to atomize the feed and to take the total mixture preferably into the riser reactor of a FCC unit (not shown) while simultaneously a suspension of hot regenerated active fluidized catalyst is passed in an upflowing manner with the help of a lift gas through lower portion of vertically oriented riser reactor at a temperature and pressure sufficient to effect the cracking and to obtain the desired liquid products with reduced sulfur content. In another embodiment the hydrocarbon feed stock is introduced into the primary mixing chamber of the said nozzle assembly through multiple entry points at an angle of about 90° for intimate mixing with carbon monoxide gas.

According to this invention the proportion of carbon monoxide gas used in the process is between about 0.5 to 10 mole percent of the feedstock, preferably about 0.5 to 5 mole % of the feedstock. The feedstock contains sulfur in the range of 0.5 to 5 wt % of the feedstock and Conradson Carbon Residue (CCR) in the range of 0.1 to 1.0 wt % of the feedstock. The FCC catalyst used can be selected from the conventional ones used in the art. It is preferable that the catalyst contains $Al_2O_3$ in the range of 30 to 50 wt % and $Re_2O_3$ in the range of 1 to 4 wt %. The catalyst used is preferably steamed catalyst. The extent of sulfur removal from the liquid products is about 50% and above. The lift gas used in the riser reactor for upflowing the catalyst includes carbon monoxide and the gas velocity is at about 1.5 to less than 15 m/s and the catalyst residence time is from about 1.0 to 10 seconds.

To perform the experiments in micro level, the MAT unit can be used with a modification for separately feeding the feed and CO to the reactor. A cylindrical split furnace is used along with the reactor to achieve the required reaction temperature.

Experimental Results

The base experiment was conducted where 0 mole % CO and 100 mole % fresh feed was used and this is considered to be the base case. For this example the process of the present invention was used as a first run followed by three runs in which CO added in a composition of 5 mole %, 7.5 mole % and 10 mole % along with the fresh feed. The typical physico-chemical properties of catalyst and feedstock are reported in Table-1 and Table-2 respectively.

Table-3 shows the data for those three runs including relevant operating conditions used in the base case. The feedstock for all the runs was high sulfur vacuum gas oil (HS-VGO). For the purpose of comparison, base case run with the identical operating conditions, that was obtained using no CO and a feedstock and conditions, where applicable, identical to the succeeding three runs.

The data in table-3 shows the distribution of yields and sulfur into the products of interest using CO having no other components into it as impurities. The results show that there is an increase in gasoline yield with a decrease in dry gas, FIN and LCO whereby LPG and coke yield remaining more or less constant. Furthermore, with the use of the CO the reduction of sulfur in gasoline up to 31% and in TCO (Total Cycle Oil) up to 45% is quite pronounced. The reduction of sulfur in liquid products has been observed to be more than 50%. We believe that the yields of heavy naphtha and light cycle oil obtained by the practice of the present invention could be improved without significantly increasing coke or dry gas make, by further optimization of the process.

The experimental results, which are based on the experiments and understanding of the conventional FCC process through many years of experience in the FCC art indicate a marked reduction of sulfur in the products through the use of CO.

Characterization of Catalyst and Feed

The selected feedstock and catalyst were characterized using appropriate characterization techniques and results of the characterization of catalyst and feedstock are tabulated in Table-1 and Table-2 respectively.

TABLE 1

Physico-Chemical Properties of Catalyst

| | |
|---|---|
| Surface Area, $m^2/gm$ | |
| Fresh | 277 |
| Steamed** | 189 |
| Pore Volume, cc/gm | 0.355 |
| Crystallinity, wt % | |
| Fresh | 23.4 |
| Steamed** | 17.5 |
| UCS, °A | |
| Fresh | 24.68 |
| Steamed** | 24.43 |
| Chemical Analysis, wt % | |
| $Al_2O_3$, | 43.18 |
| $Re_2O_3$ | 3.47 |
| Fe | <0.01 |
| $PO_4$ | <2.0 |
| Attrition Index | 3.846 |
| Loss on Ignition, wt % | 8.66 |
| Particle Size Distribution, wt % | |
| −120 | 97 |
| −105 | 93 |
| −80 | 71 |
| −60 | 42 |

TABLE 1-continued

| Physico-Chemical Properties of Catalyst | |
|---|---|
| −40 | 18 |
| −20 | 4 |
| APS, microns | 65.44 |
| ABD, gm/cc | 0.910 |

**Steamed at 788° C./3 hrs

TABLE 2

| Properties of Feed | |
|---|---|
| Density @ 15° C., gm/cc | 0.9249 |
| Sulfur, wt % | 2.5 |
| CCR | 0.26 |
| SARA, wt % | |
| Saturates | 55.5 |
| Aromatics | 44.0 |
| Asphaltene | 0.5 |
| $H_2$ Content | 12.7 |
| Total $N_2$, ppm | 895 |
| Distillation, D1160 | |
| IBP | 292 |
| 10 | 352 |
| 20 | 376 |
| 30 | 394 |
| 40 | 411 |
| 50 | 427 |
| 60 | 441 |
| 70 | 456 |
| 80 | 473 |
| 90 | 496 |
| 95 | 512 |
| FBP | 540 |
| Metals | |
| Nickel | <100 ppb |
| Vanadium | 150 ppb |
| Sodium | <100 ppb |
| Iron | 1005 ppb |
| Arsenic | <200 ppb |
| Lead | 205 ppb |
| Copper | <100 ppb |
| Silicon | <100 ppb |

Characterization of Liquid and Gaseous Products

Liquid products collected were analyzed in Simulated Distillation (SimDist) analyzer for distillation analysis, in N-S analyzer for sulfur distribution analysis and in XRF for total sulfur analysis whereas the gaseous products were analyzed in High Speed Refinery Gas Analyzer (HSRGA). Experimental results are summarized in Table-3.

TABLE 3

Yield and sulfur distribution in products

| | Base | Base + 5.0% CO | Base + 7.5% CO | Base + 10% CO |
|---|---|---|---|---|
| Normalized Yield | | | | |
| $H_2$ | 0.05 | 0.034 | 0.032 | 0.03 |
| Dry Gas | 2.47 | 1.28 | 1.32 | 1.35 |
| LPG | 17.42 | 17.15 | 17.40 | 17.55 |
| Gasoline | 30.81 | 32.27 | 32.94 | 33.2 |
| HN | 13.02 | 12.39 | 11.09 | 11.21 |
| LCO | 24.23 | 23.436 | 22.908 | 22.18 |
| TCO | 37.25 | 35.826 | 34.60 | 33.39 |
| Bottoms | 7.93 | 8.9 | 9.14 | 9.38 |

TABLE 3-continued

Yield and sulfur distribution in products

| | Base | Base + 5.0% CO | Base + 7.5% CO | Base + 10% CO |
|---|---|---|---|---|
| Coke | 4.07 | 4.54 | 4.92 | 5.1 |
| Conv, 216 | 67.84 | 67.66 | 67.70 | 68.44 |
| % reduction of sulfur in Liquid Products | — | 53.02 | 50.87 | 48.70 |
| % reduction of sulfur in Gasoline | — | 31.10 | 28.80 | 26.49 |
| % reduction of sulfur in TCO | — | 45.00 | 42.00 | 38.00 |

The embodiments of the invention disclosed herein are only illustrative. There can be several other possible embodiments of the invention also fall within the scope of this invention as would be apparent from the practice of the invention. The full scope and spirit of the invention should be derived from the following appended claims.

We claim:

1. A fluidized catalytic cracking process for converting normally liquid hydrocarbon feedstock with simultaneous reduction of sulfur content in the liquid products obtained therefrom comprising carrying out the cracking process in the presence of a reducing agent consisting of carbon monoxide gas wherein the process comprises of premixing the hydrocarbon feedstock with the carbon monoxide gas before effecting the cracking process.

2. The process as claimed in claim 1, comprising introducing preheated hydrocarbon feedstock along with carbon monoxide gas into a primary mixing chamber of a feed nozzle assembly, sweeping the mixture into a secondary mixing chamber of the said nozzle assembly where steam is introduced as a diluent medium to take the mixture preferably into a riser reactor of an FCC unit while simultaneously, passing an upflowing suspension of hot regenerated active fluidized catalyst in a lift gas into the reactor through bottom of a vertically oriented riser reactor at a temperature and residence time sufficient to effect the cracking and to obtain desired liquid products with reduced sulfur content.

3. The process as claimed in claim 2, wherein the hydrocarbon feedstock is introduced into the primary mixing chamber of the nozzle assembly through multiple entry points at an angle of about 90° for intimate mixing with carbon monoxide.

4. The process as claimed in claim 2, wherein the catalyst contains $Al_2O_3$ in the range of 30-50 wt %.

5. The process as claimed in claim 2, wherein the catalyst contains $Re_2O_3$ in the range of 1-4 wt %.

6. The process as claimed in claim 2, wherein carbon monoxide gas is used as the lift gas in the riser reactor.

7. The process as claimed in claim 2, wherein the velocity of the lift gas for upflowing the suspension of hot regenerated active fluidized catalyst into the riser reactor is at about 1.5 to less than 15 m/s and catalyst residence time is from about 1.0 to 10 sec.

8. The process as claimed in claim 2, wherein the catalyst used is steamed FCC catalyst.

9. The process as claimed in claim 1, wherein the proportion of carbon monoxide gas used in the process is between about 0.5 to 10 mole % of the feedstock.

10. The process as claimed in claim 1, wherein the feedstock contains sulfur in the range of 0.5 to 5 wt % of the feedstock.

11. The process as claimed in claim 1, wherein the feedstock contains Conradson Carbon Residue (CCR) in the range of 0.1 to 1 wt % of the feedstock.

12. The process as claimed in claim 1, wherein the reduction of sulfur in total liquid products is about 50% and above.

13. The process as claimed in claim 1, wherein the proportion of carbon monoxide gas used in the process is between about 0.5 to 5 mol % of the feedstock.

* * * * *